US010399371B2

(12) United States Patent
Yamabe

(10) Patent No.: US 10,399,371 B2
(45) Date of Patent: Sep. 3, 2019

(54) CARRIAGE

(71) Applicant: MIMAKI ENGINEERING CO., LTD., Nagano (JP)

(72) Inventor: Katsutoshi Yamabe, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/933,383

(22) Filed: Mar. 23, 2018

(65) Prior Publication Data

US 2018/0281483 A1 Oct. 4, 2018

(30) Foreign Application Priority Data

Apr. 3, 2017 (JP) ..... 2017-073987

(51) Int. Cl.

| | |
|---|---|
| ***B41J 25/34*** | (2006.01) |
| ***B41J 25/308*** | (2006.01) |
| ***B41J 2/175*** | (2006.01) |
| ***B41J 29/02*** | (2006.01) |

(52) U.S. Cl.

CPC ..... *B41J 25/34* (2013.01); *B41J 2/1752* (2013.01); *B41J 25/3082* (2013.01); *B41J 25/3086* (2013.01); *B41J 29/02* (2013.01)

(58) Field of Classification Search

CPC ..... B41J 25/3082; B41J 25/3086

See application file for complete search history.

(56) References Cited

U.S. PATENT DOCUMENTS

2012/0306967 A1* 12/2012 Shimizu ..... B41J 25/001 347/39
2013/0070022 A1* 3/2013 Ogawa ..... B41J 2/1752 347/37
2015/0352868 A1* 12/2015 Sekino ..... B41J 25/308 347/37
2018/0311983 A1* 11/2018 Saiga ..... B41J 25/3086

FOREIGN PATENT DOCUMENTS

JP 2016124121 7/2016

* cited by examiner

*Primary Examiner* — Shelby L Fidler
(74) *Attorney, Agent, or Firm* — JCIPRNET

(57) ABSTRACT

This disclosure is directed to securing, with a simple structure, a head to a position in a carriage without having to fasten screws so as to prevent possible loss of a desired printing quality. A carriage is provided that includes a main housing mounted to a printing unit body, an eccentric cam rotatably disposed in the main housing, a sub housing that holds a head that ejects ink droplets. The sub housing makes contact with a cam face of the eccentric cam and is movable upward and downward relative to the main housing in response to rotation of the eccentric cam. The carriage further includes a rotation regulator that regulates rotation of the sub housing around a rotating shaft of the eccentric cam.

11 Claims, 10 Drawing Sheets

CARRIAGE

CROSS REFERENCE TO RELATED APPLICATIONS

This application claims the priority benefit of Japanese Patent Application No. 2017-073987, filed on Apr. 3, 2017. The entirety of the above-mentioned patent application is hereby incorporated by reference herein and made a part of this specification.

TECHNICAL FIELD

This disclosure relates to a carriage provided in an image forming apparatus to hold a head that ejects ink droplets.

DESCRIPTION OF THE BACKGROUND ART

Conventionally, inkjet recording apparatuses (inkjet printers) are known as examples of image forming apparatuses that form images on recording media, such as fabric or paper, by ejecting inks onto the recording media.

The inkjet recording apparatuses may be equipped with a head that ejects ink droplets and a carriage that holds the head. The carriage moves in reciprocating motion along scanning directions. An image can be formed on the recording medium by ejecting the ink from the head during the reciprocating motion of the carriage.

For different uses of the printing scheme and types of recording media used, the head in the carriage is adjustable in position (in height) to change an interval (gap) between nozzles of the head and the recording medium, depending on the type of recording media and the purpose of printing (for example, Japanese Patent Publication Laid-open No. 2016-124121). Conventionally, the head adjusted in position may be secured with screws to the carriage in order not to drop off from the carriage.

Patent Literature: Japanese Patent Application Laid-open No. 2016-124121

SUMMARY

However, in the event that the head is secured with screws to the carriage, mounting or dismounting the head is time-consuming. Another issue may be complexity in handling the screw-loosened head during fine adjustments of the head's position (in height). On the other hand, without securing the head to the carriage using screws, the head may be displaced downward under its own weight, reducing a distance of nozzles of the head to the recording medium. This may incur loss of a desired printing quality. Further, the head may wobble during the movement of the carriage. Then, keeping a constant distance between nozzles of the head and the recording medium may not be possible, leading to loss of a desired printing quality.

To address the issues of the known art, this disclosure provides a carriage that may allow a head to be immovably positioned in a simplified manner without fastening screws and that may prevent possible loss of a desired printing quality.

This disclosure provides a carriage, including a main housing mounted to a printing unit body, an eccentric cam rotatably disposed in the main housing, a sub housing that holds a head that ejects ink droplets, the sub housing making contact with a cam face of the eccentric cam and being movable upward and downward relative to the main housing in response to rotation of the eccentric cam, and a rotation regulator that regulates rotation of the sub housing around a rotating shaft of the eccentric cam.

In the carriage thus structured, the sub housing is not secured to the main housing but is disposed in contact with the eccentric cam. While the sub housing possibly rotates under its own weight around the rotating shaft of the eccentric cam, the rotation regulator may regulate rotation of the sub housing and prevent resulting rotation of the head supported and held in the sub housing. Such a simple structural configuration may allow the head to be immovably positioned in the carriage without having to secure the sub housing holding the head to the main housing using screws. This may prevent possible loss of a desired printing quality.

According to an aspect, the rotation regulator may be disposed in one of the main housing and the sub housing at a position opposite to contact parts of the sub housing with the eccentric cam across the rotating shaft of the eccentric cam and may contact the other one of the main housing and the sub housing.

The rotation regulator disposed in the sub housing (or main housing) may contact the main housing (or sub housing) to regulate rotation of the sub housing, preventing resulting rotation of the head supported and held in the sub housing.

According to an aspect, the rotation regulator may be disposed in the main housing and protrudes into a rotational trajectory of the sub housing to contact the sub housing.

By having the sub housing thus protruding into the rotational trajectory of the sub housing, the sub housing, while possibly starting to rotate around the rotating shaft of the eccentric cam, may be deterred from rotating by making contact with the rotation regulator. This may prevent resulting rotation of the head supported and held in the sub housing.

According to an aspect, the sub housing may have an energizer that pushes the sub housing in a direction of rotation of the sub housing around the axis of the eccentric cam.

By thus applying a pushing force using the energizer to the sub housing in a direction in which rotation of the sub housing is regulated by the rotation regulator, the sub housing may certainly be prevented from rotating. This may more effectively prevent possible rotation of the head.

According to an aspect, the energizer may have one end attached to the main housing and another end attached to the sub housing, and the energizer may extend in a direction intersecting with a perpendicular passing through center of the rotating shaft of the eccentric cam to energize the sub housing.

By thus applying a pushing force using the energizer to the sub housing in a direction away from the center of rotation of the eccentric cam, the sub housing may be exactly pushed in the direction in which the sub housing may possibly start to rotate.

According to an aspect, the carriage may further include a sliding regulator that regulates sliding motion of the sub housing relative to the main housing in a direction along the rotating shaft of the eccentric cam.

The sliding regulator may suppress wobbling of the head in the direction along the rotating shaft of the eccentric cam. Such a simple structural configuration may allow the head to be immovably positioned in the carriage. This may prevent possible loss of a desired printing quality.

According to an aspect, the sliding regulator may have one end attached to the main housing and another end attached to the sub housing, and the sliding regulator may extend in the direction along the rotating shaft of the eccentric cam to energize the sub housing.

By thus having the sliding regulator push the sub housing and the main housing in the direction along the axis of rotation of the sub housing, the sub housing may be exactly pushed in a direction in which the sub housing may possibly start to slide along the axis of rotation.

According to an aspect, the cam face of the eccentric cam may have a plurality of continuous planes, and the sub housing may have a contact plate that makes face contact with any one of the plurality of planes on the cam face.

The face contact between the contact plate and the cam face of the eccentric cam may suppress displacement of the head.

According to an aspect, the carriage may further include an operating part that allows the eccentric cam to axially rotate.

The position of the head may be suitably adjusted by simply rotating the operating part.

As thus far described, the carriage according to this disclosure may allow the head to be immovably positioned in the carriage in a simplified manner without a screw-fastening means and that may prevent possible loss of a desired printing quality.

DETAILED DESCRIPTION OF EMBODIMENT

An embodiment of the carriage disclosed herein is hereinafter described with reference to the accompanying drawings. Hereinafter, an image forming apparatus is described, and the description includes detailed description of the carriage, a component of the image forming apparatus.

[Image Forming Apparatus]

Figure 1:
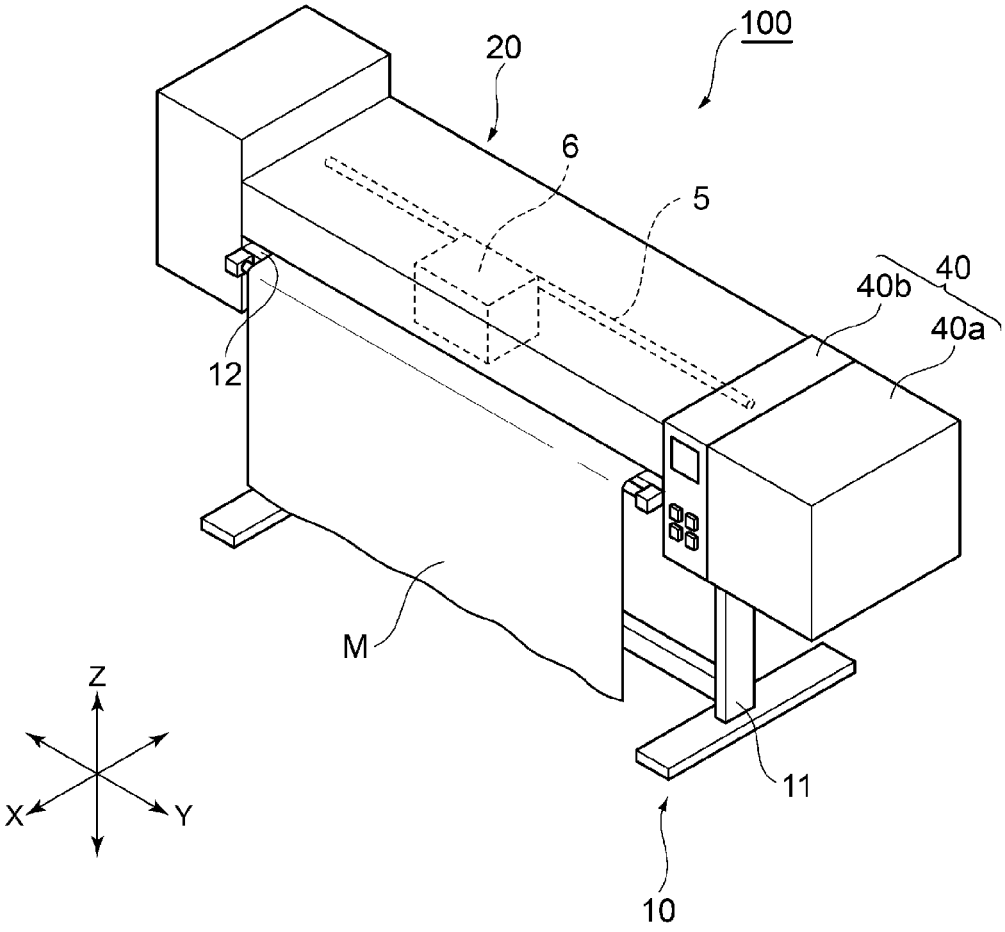
FIG. 1 is a schematic perspective view of an image forming apparatus.

As illustrated in FIG. 1, an image forming apparatus 100 is an inkjet printer that forms an image on a recording medium M using a plurality of color inks. The image forming apparatus 100 includes a body unit 10, a printing unit 20, and a control unit 40.

The recording medium M may be any one selected from different media (either permeable or non-permeable) using various materials including paper, unwoven fabric, vinyl chloride, synthesized chemical fiber, polyethylene, polyester, tarpaulin, and acrylic plates. Examples of usable inks may include solvent-based inks (typically, photo-curable inks), aqueous inks (typically, dye inks, pigment inks), and solid inks.

<Body Unit, Control Unit>

As illustrated in FIG. 1, the body unit 10 includes a base 11 having legs, and a platen 12 disposed at a position above the base 11. The recording medium M is set on the upper surface of the platen 12.

The base 11 supports and holds the platen 12 from below and keeps the upper surface of the platen 12 in a substantially horizontal position. The platen 12 is adjustable in height and inclination.

As illustrated in FIG. 1, the control unit 40 is disposed at a position on a lateral side of the printing unit 20, i.e., a position being in the upper direction of the recording medium M and being remotely displaced from the recording medium M. The control unit 40 includes a controller 40*a* and an operating part 40*b*. The controller 40*a* controls a printing operation carried out by the printing unit 20, specifically, ink ejection control for the head, drive control for the carriage, transport control for the recording medium M, and cleaning control for the head. The operating part 40*b* may include a touch-panel display, a speaker, and buttons. A user inputs printing instructions using the operating part 40*b*.

<Printing Unit>

As illustrated in FIGS. 1 to 10, the printing unit 20 is equipped with heads 3 having nozzles through which ink droplets are ejected, head holders 4 that hold the heads 3, a guide rail (Y bar) 5, and a carriage 6 movable in Y direction along the guide rail 5.

The printing unit 20, while moving the carriage 6 in reciprocating motion in a main scanning direction (Y direction), ejects ink droplets repeatedly toward the same position (image region with a predetermined width) on the recording medium M to complete an image to be formed. The Y direction, main scanning direction, is orthogonal to X direction which is a direction of transport of the recording medium M.

<Head>

Figure 2:
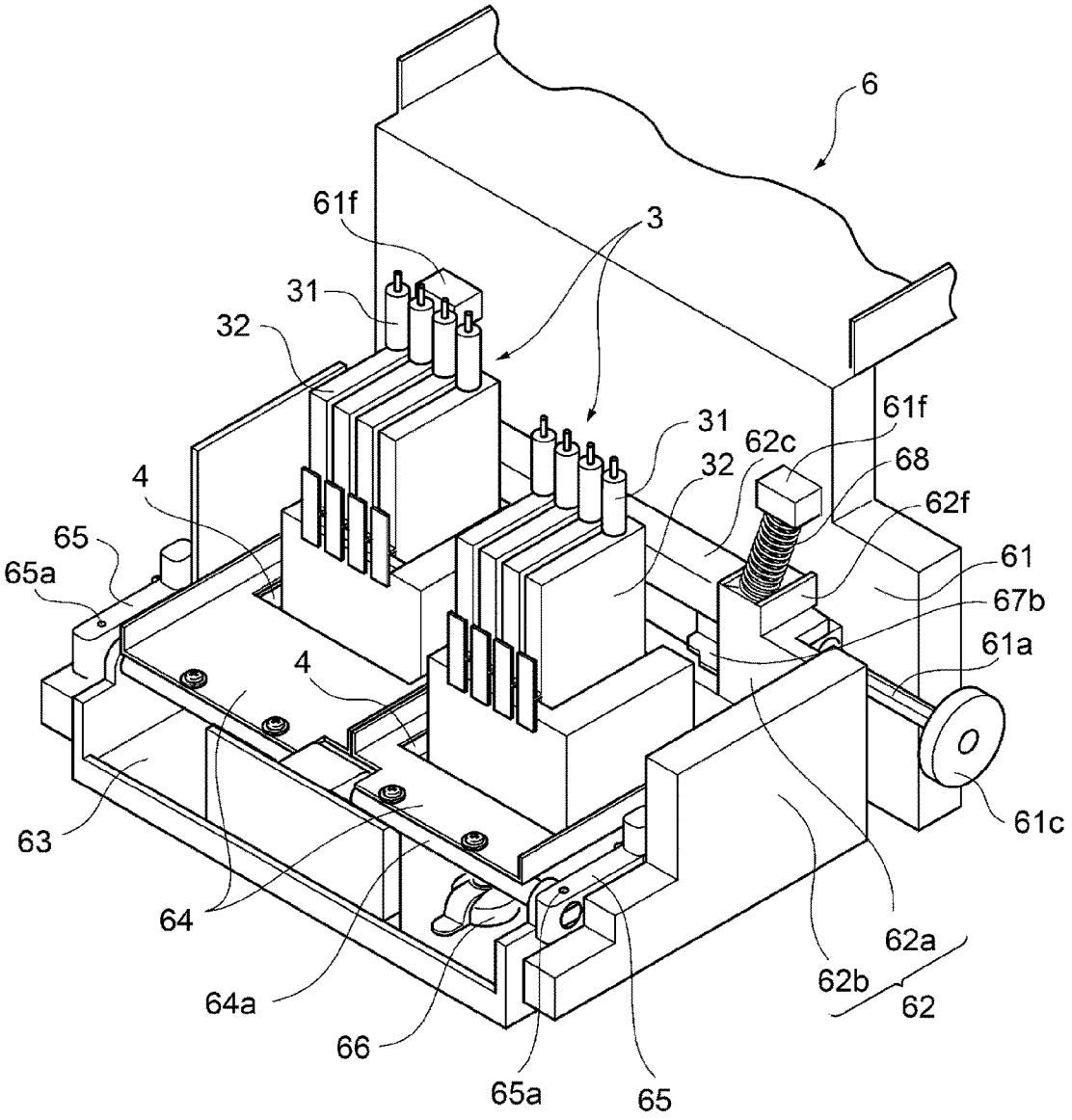
FIG. 2 is a perspective view of a carriage mounted with a head.

As illustrated in FIG. 2, each head 3 has a substantially box-like shape and has a plurality of nozzles formed on its bottom surface to eject droplets of cyan (C), magenta (M), yellow (Y), and black (K) color inks. The upper surface of the head 3 opposite to the bottom surface has an ink feed port 31 which is coupled to an ink feed tube for feeding the head 3 with the inks. There are ink reservoirs 32 between the upper and bottom surfaces of the head 3. The ink reservoir 32 temporarily stores a small quantity of ink. The number of nozzles may depend on the number of color inks desirably used.

<Head Holder>

As illustrated in FIG. 2, each head holder 4 holds the head 3, so that nozzles on the bottom surface of the head 3 are exposed. The head holders 4 are mountable in and removable from the carriage 6, and are supported and held in the carriage 6. The head holder 4 is so shaped as to support the bottom-surface side of the head 3 and to enclose the side wall surface of the head 3 on its outer side.

<Guide Rail>

As illustrated in FIG. 1, the guide rail 5 is extending above the platen 12 in the direction (Y direction) orthogonal to the transport direction (X direction) of the recording medium M on the platen 12. The guide rail 5, which may be referred to as Y bar, holds the carriage 6 in a manner that the carriage 6 is movable in reciprocating motion along the Y direction.

<Carriage>

Figure 3:
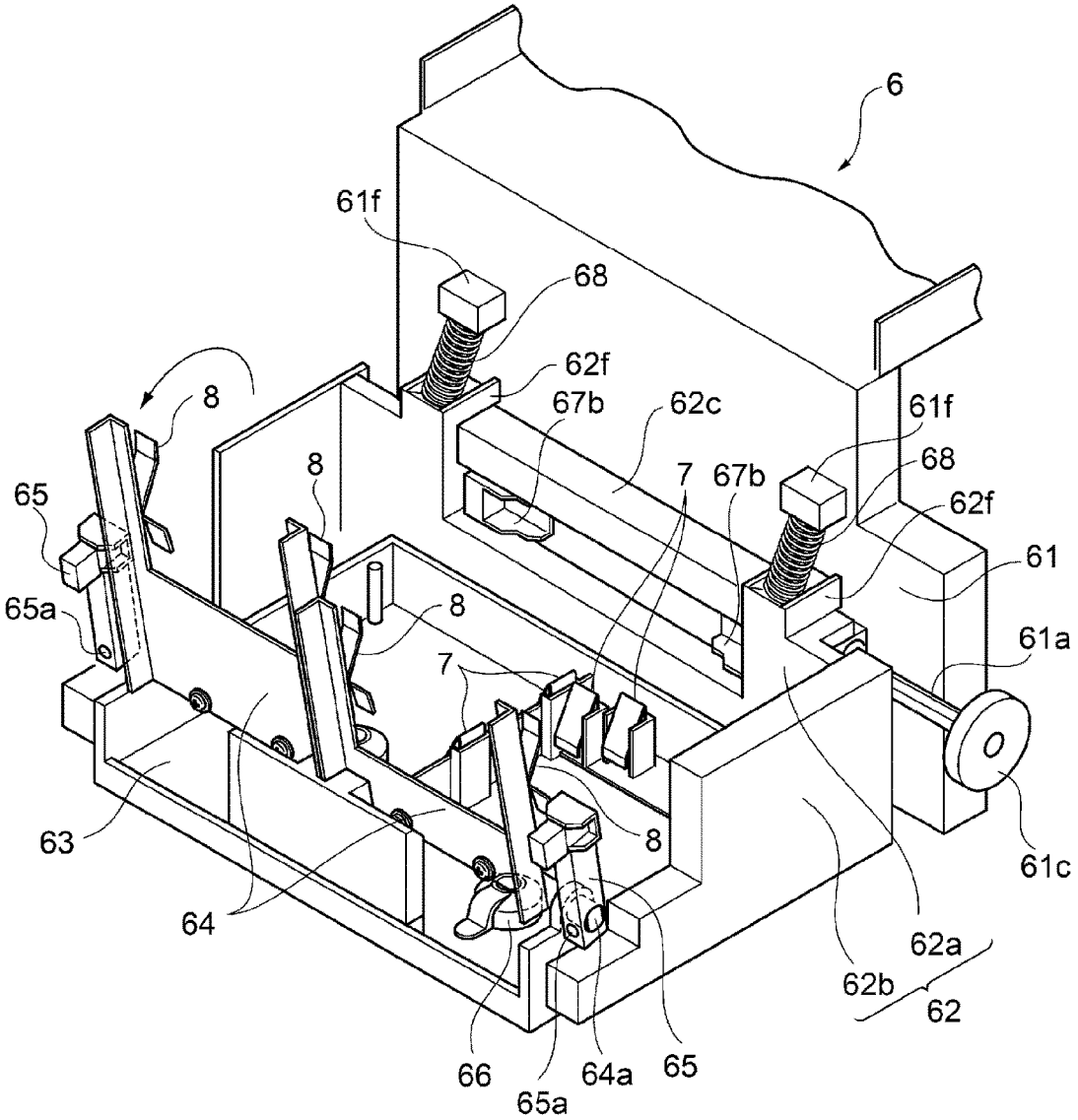
FIG. 3 is a perspective view of the carriage after the head is removed.
Figure 4:
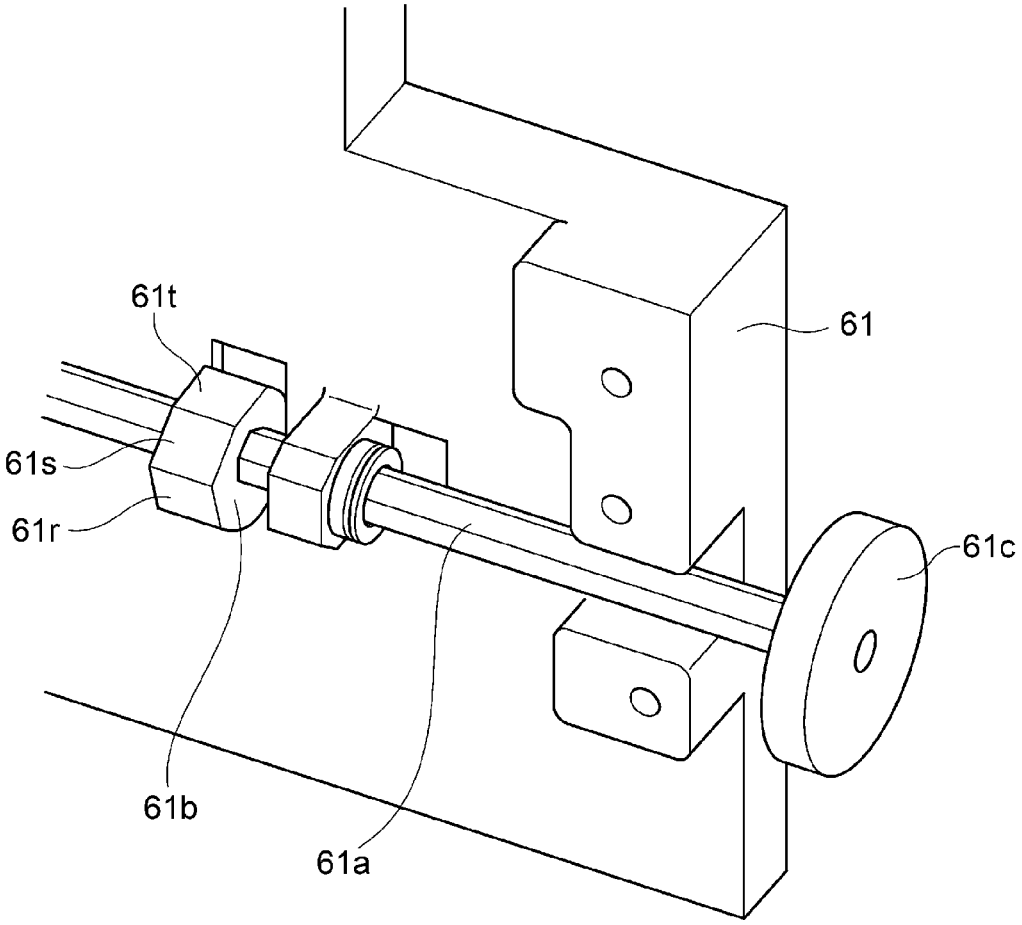
FIG. 4 is a perspective view of an adjusting cam.

As illustrated in FIGS. 2 to 4, the carriage 6 is movable in reciprocating motion in the Y direction along the guide rail (Y bar) 5. The carriage 6 holds the head holders 4 in a manner that the nozzles on the bottom surfaces of the heads 3 are exposed. In this embodiment, the carriage 6 is structured to hold two head holders 4. Optionally, the carriage 6 may be structured to hold one head holder 4 or three or more head holders 4.

The carriage 6 includes a main housing 61, a sub housing 62, a base plate 63, covers 64 with fixing levers 65, eccentric cams 66, rotation regulators 67, energizers 68, and a sliding regulator 69. The main housing 61 is engaged with the guide rail 5 in a manner that the main housing 61 is movable in reciprocating motion along the Y direction. The sub housing 62 is engaged with the main housing 61. The base plate 63 is secured to the sub housing 62. The covers 64 are attached to the base plate 63 in a rotatable manner. The eccentric cams 66 are attached to the base plate 63 in a rotatable manner. The rotation regulators 67 regulate possible rotation of the sub housing 62 relative to the main housing 61. The energizers 68 push the sub housing 62 in a direction in which the sub housing 62 may rotate under its own weight. The sliding regulator 69 regulates sliding motion of the sub housing 62 relative to the main housing 61 in a transverse direction (direction along the axis of rotation of the sub housing 62).

As illustrated in FIGS. 2 to 5, the main housing 61 constitutes the back-face wall of the carriage 6. The back surface of the main housing 61 is engaged with the guide rail 5 in a manner that the main housing 61 is movable in reciprocating motion. On the front-face side of the main housing 61 are disposed the sub housing 62 and the base plate 63.

The main housing 61 has a rotating shaft 61*a* disposed in an axially rotatable manner, and an adjusting cam 61*b* pivotably supports the rotating shaft 61*a*. The adjusting cam 61*b* is engageable with the sub housing 62 to adjust positions (in height) of the heads 3. The adjusting cam 61*b* is an eccentric cam having a cam face that varies in distance to the cam's center. The cam face of the adjusting cam 61*b* has a plurality of continuous planes 61*r*, 61*s*, and 61*t*. These planes 61*r*, 61*s*, and 61*t* are so shaped as to differ in distance to the rotational center of the adjusting cam 61*b*. An operating part (operating handle) 61*c* is attached to one end of the rotating shaft 61*a*. The operating part 61*c* axially rotates the rotating shaft 61*a* to adjust positions of the heads 3.

As illustrated in FIGS. 2 to 5, the sub housing 62 is engaged with the main housing 61 on the front side of the main housing 61. The sub housing 62 is not undetachably secured to the main housing 61 with such means as screws but is engaged with the main housing 61 in a manner that the sub housing 62 is movable upward and downward along the height direction (vertical direction) of the head 3. The sub housing 62 has wall parts 62*a* along the front-face wall of the main housing 61, and arm parts 62*b* extending from both ends of the wall parts 62*a* toward the opposite side of these wall parts (toward the front side of the carriage 6). The sub housing 62 is provided with a contact plate 62*c* that makes contact with the adjusting cam 61*b*. The contact plate 62*c* is formed by bending its plate material and has a substantially L-like shape in a lateral view. The contact plate 62*c* is disposed so that one surface thereof selectively makes face contact with the cam face (plane) 61*r*, 61*s*, or 61*t* of the adjusting cam 61*b*.

As illustrated in FIGS. 2 and 3, the base plate 63 is situated in a space surrounded by the wall parts 62*a* and the arm parts 62*b* of the sub housing 62. The base plate 63 is secured to the sub housing 62 with, for example, screws. The base plate 63 has leaf springs 7 serving as energizers. The leaf springs 7 push the head holders 4 attached to the base plate 63 toward the base plate 63 to prevent wobbling of the heads 3 and securely position the heads 3.

As illustrated in FIGS. 2 and 3, the covers 64 push the head holders 4 attached to the base plate 63 from above to prevent the head holders 4 from being detached from the base plate 63. One ends of the covers 64 are attached to a rotating shaft 64*a* rotatably mounted to the base plate 63. This allows the covers 64 to rotate on the base plate 63. The covers 64 for the head holders 4 are respectively attached to the rotating shafts 64*a*. The covers 64 are attached to the rotating shaft 64*a* in a manner that these covers are movable to and from two positions in upper and lower directions of the head holders 4 supported and held on the base plate 63. The covers 64, when they are at positions above the head holders 4, are facing upper surfaces of the head holders 4. The covers 64 then push the upper surfaces of the head holders 4 downward against the base plate 63. There are leaf springs 8 serving as energizers, on surfaces of the covers 64 that face the head holders 4. The leaf springs 8 push the head holders 4 attached to the base plate 63 from above toward the base plate 63 to prevent the heads 3 and the head holders 4 from being detached from the base plate 63.

As illustrated in FIGS. 2 and 3, fixing levers 65 are respectively attached to both ends of the rotating shaft 64*a* and rotate synchronously to the rotation of the rotating shaft 64*a*. The fixing levers 65 are attached to the rotating shaft 64*a* in a manner that these fixing levers are rotatable around axles 65*a* extending in a direction orthogonal to the axial direction of the rotating shaft 64*a*. The fixing levers 65 are allowed to rotate around the axles 65*a* to and from two positions at which the fixing levers 65 are engageable with and are not engageable with the base plate 63. The fixing levers 65 engaged with the base plate 63 from below are restricted from rotating, and the rotating shaft 64*a* is correspondingly restricted from rotating. As a result, the covers 64 are not allowed to rotate. When the fixing levers 65 are rotated around the axles 65*a* and disengaged from the base plate 63, the fixing levers 65 are no longer restricted from rotating. This may allow the rotating shaft 64*a* to rotate and allow the covers 64 to correspondingly rotate around the rotating shaft 64*a*.

As illustrated in FIGS. 2 and 3, the eccentric cams 66 are attached to the base plate 63 in a rotatable manner. The eccentric cam 66 is disposed so as to contact the outer wall surface of the head holder 4 supported and held on the base plate 63. When the eccentric cam 66 rotates, the head holder 4 is moved on the base plate 63 in accordance with a distance from the center of rotation of the eccentric cam 66.

As illustrated in FIGS. 5 to 8, there are two different types of rotation regulators 67 that are disposed at two positions.

Figure 5:
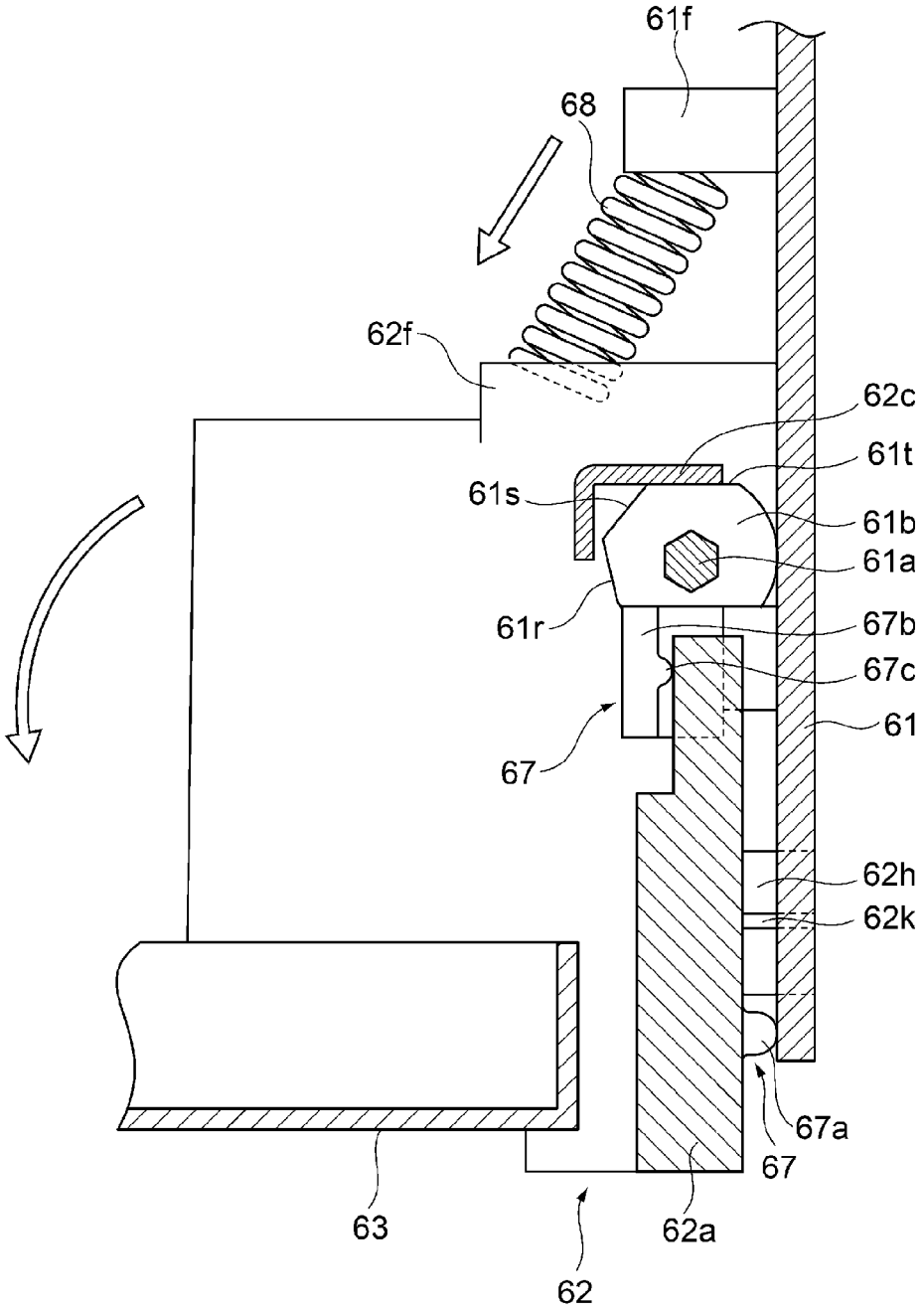
FIG. 5 is a cross-sectional view of the carriage from a lateral side.
Figure 8:
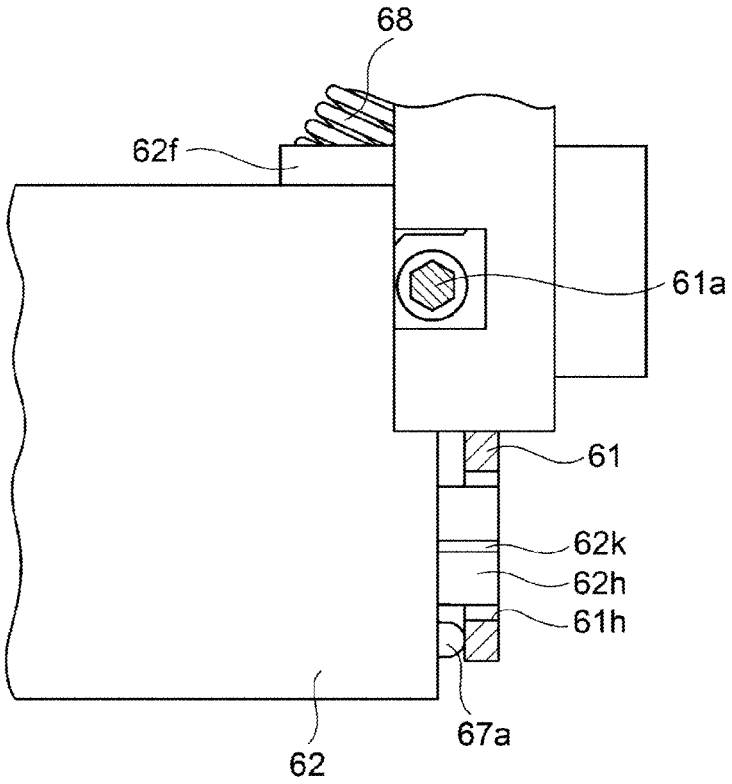
FIG. 8 is a side view of a rotation regulator (protrusion).

One of them is a protrusion 67*a*, as illustrated in FIGS. 5 and 8. The protrusions 67*a* are each disposed on the back-face side of the wall part 62*a* of the sub housing 62. The protrusion 67*a* protrudes from the back-face side of the wall part 62*a* of the sub housing 62 toward the main housing 61. The protrusions 67*a* are disposed at positions opposite to contact plate parts of the sub housing 62 with the adjusting cam 61*b* (cam face 61*r*, 61*s*, 61*t* of the contact plate 62*c*) across the rotating shaft 61*a* of the adjusting cam 61*b*. The protrusions 67*a* thus located contact the main housing 61. The protrusions 67*a* may be formed on the wall surface of the main housing 61, in which case the protrusions 67*a* contact the back surfaces of the wall parts 62*a* of the sub housing 62.

Figure 6:
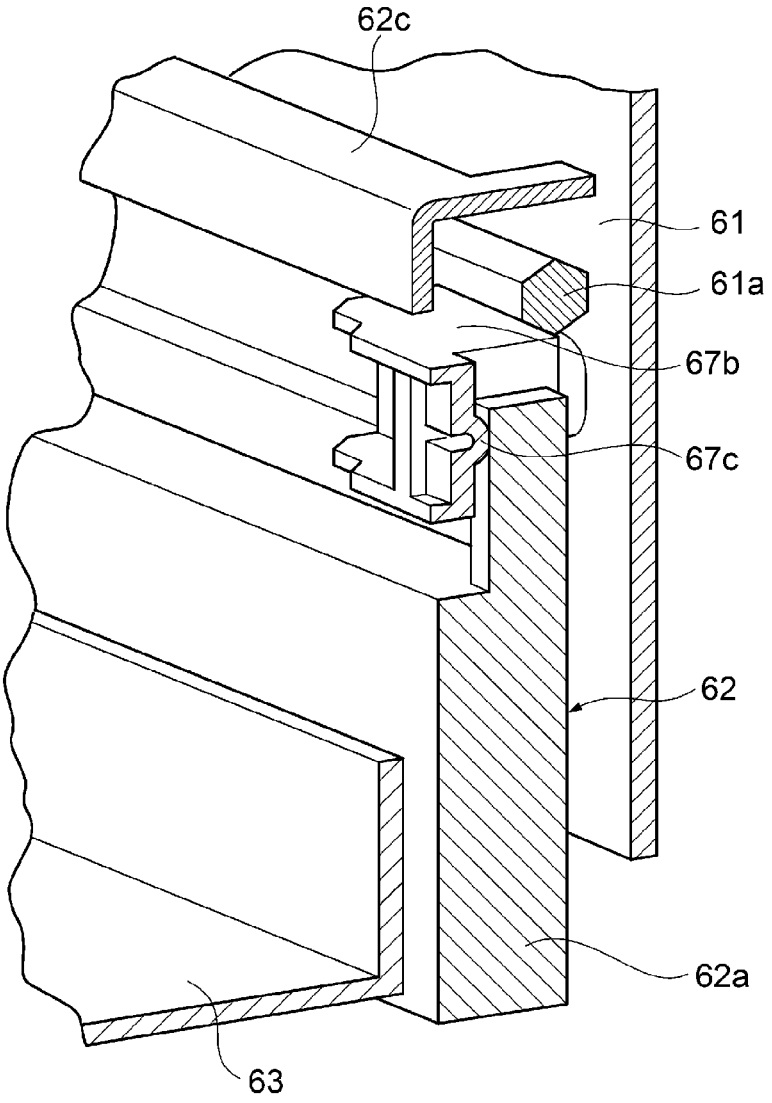
FIG. 6 is a perspective view in cross section of a rotation regulator (stopper).
Figure 7:
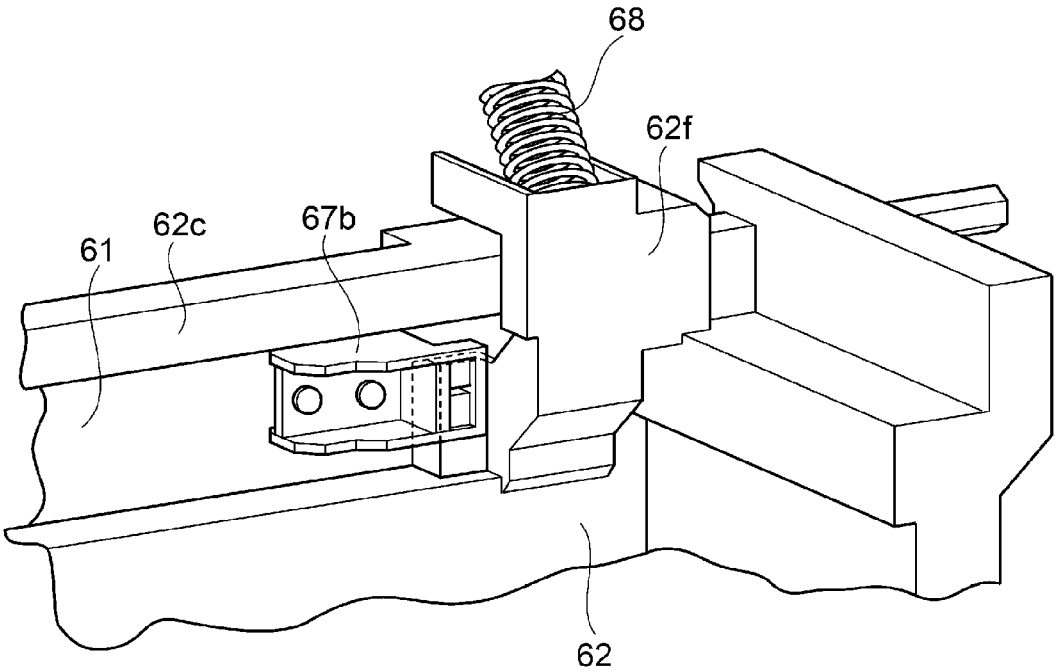
FIG. 7 is a perspective view of a rotation regulator (stopper).

The other rotation regulator is a stopper 67*b* disposed in the main housing 61, as illustrated in FIGS. 5 to 7. The stoppers 67*b* are secured with, for example, screws to the wall surface of the main housing 61 closer to the sub housing 62. As with the protrusions 67*a*, the stoppers 67*b* are disposed at positions opposite to contact plate parts of the sub housing 62 with the adjusting cam 61*b* (surfaces in contact of the contact plate 62*c* and the cam face 61*r*, 61*s*, 61*t*) across the rotating shaft 61*a* of the adjusting earn 61*b*. An edge part of the stopper 67*b* protrudes toward the front side of the wall part 62*a* of the sub housing 62, so that the wall part 62*a* of the sub housing 62 is partly nipped between the stopper 67*b* and the main housing 61. The stoppers 67*b* protrude into the rotational trajectory of the sub housing 62 to contact the sub housing 62. The edge parts of the stoppers 67*b* each have a projection 67*c* extending toward the wall part 62*a* of the sub housing 62 facing the stopper 67*b*.

As illustrated in FIGS. 2, 3, and 5, the energizers 68 may include coil springs 68. The coil springs 68 push the sub housing 62 in a direction of rotation of the sub housing 62 around the axis of the adjusting cam 61*b*. The coil springs 68 are each compressed to reduce in length than in natural state. One end of the coil spring 68 is attached to a receiver 61*f* of the main housing 61, while the other end of the coil spring 68 is attached to a receiver 62*f* formed in the sub housing 62. In the carriage 6 in which the head 3 has been set in an upright position, as illustrated in FIG. 5, a straight line interconnecting the receivers 61*f* and 62*f* extend in a direction in which the straight line intersects with a perpendicular passing through the center of the rotating shaft 61*a* of the adjusting cam 61*b*. Then, the coil spring 68 supported by the receivers 61*f* and 62*f* extend obliquely relative to the perpendicular passing through the center of the rotating shaft 61*a* of the adjusting cam 61*b*. The coil springs 68, using their restoring force, energize and push the sub housing 62 obliquely downward.

Figure 9:
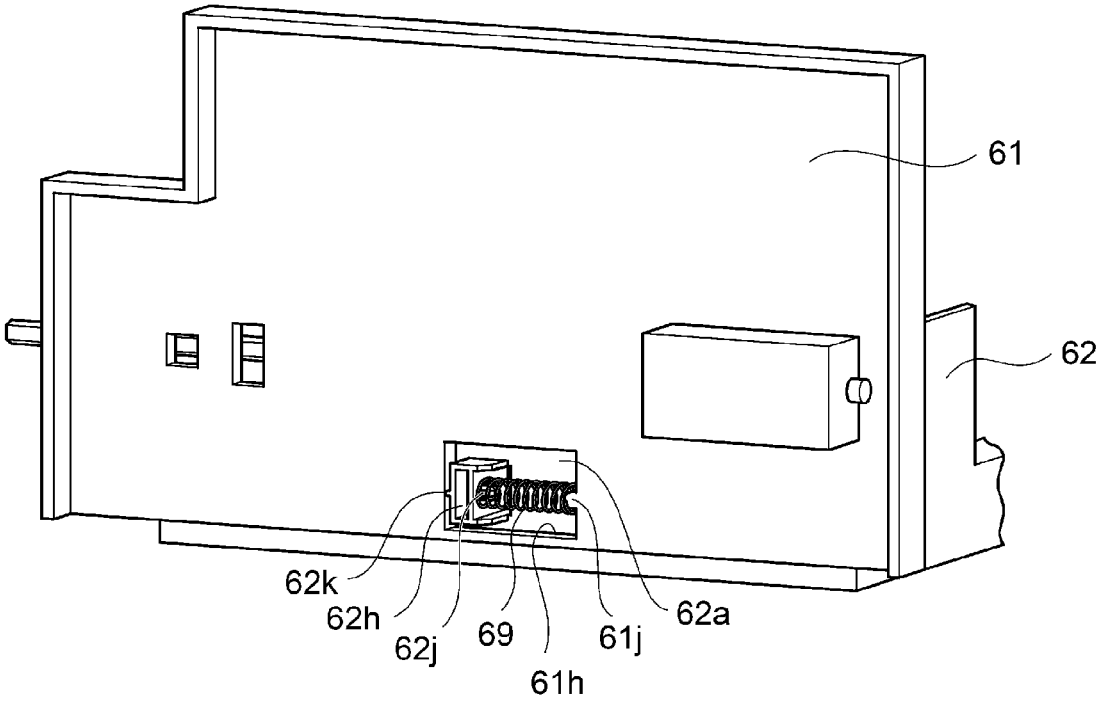
FIG. 9 is a perspective view of a main housing from its back side.
Figure 10:
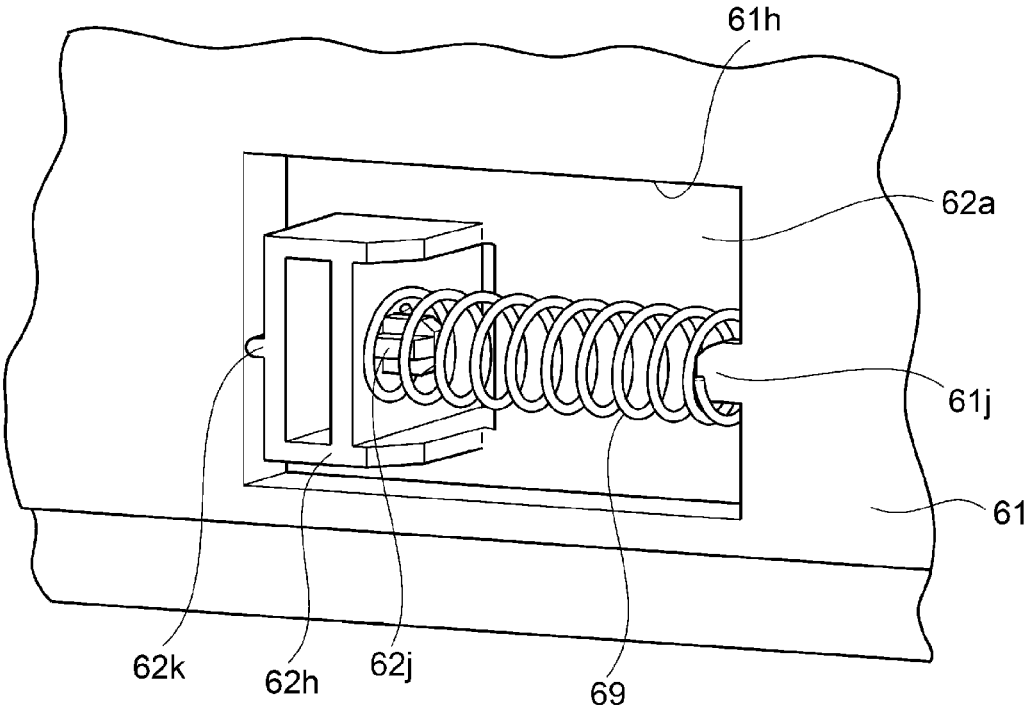
FIG. 10 is a perspective view of a sliding regulator.

As illustrated in FIGS. 9 and 10, the sliding regulator 69 is disposed on the back-face side of the main housing 61. The sliding regulator 69 may include a coil spring 69. The coil spring 69 pushes the sub housing 62 to the main housing 61 to regulate sliding motion of the sub housing 62 relative to the main housing 61 in the transverse direction (direction along the axis of the rotating shaft 61*a*).

The main housing 61 has an opening 61*h*. In an edge part of the opening 61*h* is formed a receiver 61*j* to which one end of the coil spring 69 is attachable.

A protrusion 62*h* is formed on the back-face side of the wall parts 62*a* of the sub housing 62. The protrusion 62*h* is fitted in the opening 61*h* of the main housing 61. In a part of the protrusion 62*h* opposite to the receiver 61*j* is forming a receiver 62*j* to which the other end of the coil spring 69 is attachable. In a part of the protrusion 62*h* opposite to the opening 61*h* on the back-face side of the receiver 62*j* is formed a projection 62*k* that makes contact with a peripheral edge of the opening 61*h*. The coil spring 69 compressed to reduce in length than in natural state is fitted in between the receivers 61*j* and 62*j*. A straight line interconnecting the receivers 61*j* and 62*j* extends in the axial direction of the rotating shaft 61*a* of the adjusting cam 61*b* (transverse direction of the carriage 6). Then, the coil spring 69 supported by the receivers 61*j* and 62*j* is located so as to extend in the axial direction of the rotating shaft 61*a* of the adjusting cam 61*b*. The coil spring 69, using its own restoring force, energizes and pushes the protrusion 62*h* of the sub housing 62 toward the peripheral edge of the opening 61*h* formed in the main housing 61.

The carriage 6 of the image forming apparatus 100 described so far is characterized in that the sub housing 62 is not secured to the main housing 61. Instead, the carriage 6 is simply structured to have the contact plate 62*c* make contact with the cam face 61*r*, 61*s*, 61*t* of the adjusting cam 61*b*. In the carriage 6 thus structured, the center of gravity of the sub housing 62 including, for example, the heads 3 does not lie immediately below the center of rotation of the adjusting cam 61*b*. The sub housing 62, therefore, may possibly start to rotate downward around the rotating shaft 61*a* of the adjusting cam 61*b* under the weights of the sub housing 62 itself, base plate 63, heads 3, and others. In the carriage 6, however, the protrusions 67*a* facing the main housing 61 contact the main housing 61, and the stoppers 67*b* protruding into the rotational trajectory of the sub housing 62 contact the wall parts 62*a* of the sub housing 62. This may regulate rotation of the sub housing 62, preventing resulting rotation of each head 3 supported and held in the sub housing 62. Such a simple structural construction may allow the heads 3 to be immovably positioned in the carriage 6 without having to secure the sub housing 62 holding the heads 3 to the main housing 61 using screws. This may prevent possible loss of a desired printing quality.

The coil springs 68 serving as energizers, push the sub housing 62 in the direction of rotation of the sub housing 62 around the rotating shaft 61*a* of the adjusting cam 61*b*. Accordingly, a pushing force is applied by the coil springs 68 to the sub housing 62 in a direction in which rotation of the sub housing 62 is regulated by the protrusions 67*a* and the stoppers 67*b*. This may more effectively prevent rotation of the sub housing 62 and may further ensure that the heads 3 are prevented from rotating.

The coil springs 68 extend in the direction intersecting with a perpendicular passing through the center of the rotating shaft 61*a* of the adjusting cam 61*b* and energize the sub housing 62. The coil springs 68, therefore, push the sub housing 62 in a direction away from the center of rotation of the adjusting cam 61*b*. Then, the sub housing 62 may be exactly pushed in the direction in which the sub housing 62 may possibly rotate.

The coil spring 69 serving as a sliding regulator is disposed so as to push the protrusion 62*h* of the sub housing 62 in the transverse direction (axial direction of the rotating shaft 61*a* of the adjusting cam 61*b*) against the peripheral edge of the opening 61*h* of the main housing 61. This may suppress sliding motion in the transverse direction of the heads 3 (wobbling) supported and held in the sub housing 62. Such a simplified means may allow the heads 3 to be securely positioned in the carriage 6 and may thereby prevent possible loss of a desired printing quality.

The cam face of the adjusting cam 61*b* includes the continuous planes 61*r*, 61*s*, and 61*t*, while the sub housing 62 has the contact plate 62*c* that selectively makes face contact with any one of the planes 61*r*, 61*s*, and 61*t* on the cam face. The face contact between the contact plate 62*c* and the cam face (plane) 61*r*, 61*s*, 61*t* of the adjusting cam 61*b* may effectively prevent possible displacement of each head 3.

The rotating shaft 61*a* of the adjusting cam 61*b* has the operating part 61*c* used to axially rotate the adjusting cam 61*b*. A user is able to adjust the position of each head 3 by simply rotating the operating part 61*c*.

The embodiment described so far is a non-limiting example of this disclosure. Any modifications may be made within the scope of the matters disclosed herein. For example, the carriage 6 mounted with two head holders is a non-limiting structural example.

The number of the head holders mountable in the carriage may be optionally changed. The number of planes on the cam face may be optionally changed depending on the number of position-adjusting stages of the heads 3.

The positions of the rotation regulators 67 may not be necessarily two positions, which may instead be one position or three or more positions insofar as the rotation regulator(s) is allowed to successfully regulate rotation of the sub housing 62 around the rotating shaft 61*a* of the adjusting cam 61*b*.

Instead of the sliding regulator 69 disposed at one position in this description, a plurality of sliding regulators 69 may be respectively disposed at two or more positions insofar as they are allowed to successfully regulate sliding motion of the sub housing 62 in the transverse direction (axial direction of the rotating shaft 61*a*).

What is claimed is:

1. A carriage, contained in a printing unit body and moving in a reciprocating motion along a guide rail in a main scanning direction, comprising:

a main housing provided as a part of the carriage;

an eccentric cam rotatably disposed in the main housing;

a sub housing that holds a head that ejects ink droplets, the sub housing making contact with a cam face of the eccentric cam and being movable upward and downward relative to the main housing in response to rotation of the eccentric cam;

a rotation regulator that regulates rotation of the sub housing around a rotating shaft of the eccentric cam, wherein the rotation regulator is disposed in at least one position in either the main housing or the sub housing; and a sliding regulator that regulates a motion of the sub housing relative to the main housing in a direction along the rotating shaft of the eccentric cam when the eccentric cam rotates, wherein the sliding regulator is an energizer that has one end attached to the main housing and another end attached to the sub housing, and the sliding regulator extends in the direction along the rotating shaft of the eccentric cam to energize the sub housing, and the energizer of the sliding regulator enables the sub housing being movable upward and downward relative to the main housing in response to rotation of the eccentric cam and has an energizing force that suppresses the motion in the direction along the rotating shaft of the eccentric cam when the carriage moving in the reciprocating motion in the main scanning direction.

2. The carriage according to claim 1, wherein the rotation regulator is disposed on a wall surface of a side of the sub housing adjacent to the main housing or on a wall surface of a side of the main housing adjacent to the sub housing, the rotation regulator is disposed at a position opposite to contact plate parts of the sub housing, at which the sub housing contacts the eccentric cam, such that the rotating shaft of the eccentric cam is disposed between the rotation regulator and the contact plate parts, wherein the rotation regulator disposed on the wall surface of the side of the sub housing contacts the main housing which is opposite to the sub housing, and the rotation regulator disposed in the wall surface of the side of the main housing contacts the sub housing which is opposite to the main housing.

3. The carriage according to claim 2, wherein the sub housing has an energizer that pushes the sub housing in a direction of rotation of the sub housing around the rotating shaft of the eccentric cam.

4. The carriage according to claim 2, further comprising an operating part that allows the eccentric cam to axially rotate.

5. The carriage according to claim 1, wherein the rotation regulator is disposed in the main housing and protrudes into a rotational trajectory of the sub housing to contact the sub housing.

6. The carriage according to claim 5, wherein the sub housing has an energizer that pushes the sub housing in a direction of rotation of the sub housing around the rotating shaft of the eccentric cam.

7. The carriage according to claim 5, further comprising an operating part that allows the eccentric cam to axially rotate.

8. The carriage according to claim 1, wherein the sub housing has an energizer that pushes the sub housing in a direction of rotation of the sub housing around the rotating shaft of the eccentric cam.

9. The carriage according to claim 8, wherein the energizer has one end attached to the main housing and another end attached to the sub housing, and extends in a direction intersecting with a perpendicular passing through center of the rotating shaft of the eccentric cam to energize the sub housing.

10. The carriage according to claim 1, further comprising an operating part that allows the eccentric cam to axially rotate.

11. A carriage, contained in a printing unit body and moving in a reciprocating motion along a guide rail in a main scanning direction, comprising:

a main housing provided as a part of the carriage;

an eccentric cam rotatably disposed in the main housing;

a sub housing that holds a head that ejects ink droplets, the sub housing making contact with a cam face of the eccentric cam and being movable upward and downward relative to the main housing in response to rotation of the eccentric cam;

a rotation regulator that regulates rotation of the sub housing around a rotating shaft of the eccentric cam, wherein the rotation regulator is disposed in at least one position in either the main housing or the sub housing; and a sliding regulator that regulates a motion of the sub housing relative to the main housing in a direction along the rotating shaft of the eccentric cam when the eccentric cam rotates, wherein the cam face of the eccentric cam includes a plurality of planes which are continuous and differ in distance to a rotational center of the cam face, and the sub housing has a contact plate that makes face contact with any one of the plurality of planes on the cam face.

* * * * *